US005566618A

United States Patent [19]

Frazzitta

[11] Patent Number: 5,566,618

[45] Date of Patent: Oct. 22, 1996

[54] METHOD AND APPARATUS FOR USE IN OFFSET PRINTING

[76] Inventor: Joseph Frazzitta, 279 Cherry Pl., East Meadow, N.Y. 11554

[21] Appl. No.: 510,761

[22] Filed: Aug. 3, 1995

[51] Int. Cl.[6] ..... B41L 15/10

[52] U.S. Cl. ..... 101/492; 101/471; 101/152; 101/401.1; 430/329; 430/945; 430/300

[58] Field of Search ..... 101/486, 492, 101/401.1, 375, 483, 211, 467, 170, 471, 152; 430/307, 329, 945, 300

[56] References Cited

U.S. PATENT DOCUMENTS

| | | | |
|---|---|---|---|
| 3,636,251 | 1/1972 | Daly et al. | 101/401.1 |
| 3,832,948 | 9/1974 | Barker | 101/401.1 |
| 4,181,077 | 1/1980 | Dalton | 101/401.1 |
| 4,395,946 | 8/1983 | Price . | |
| 4,526,098 | 7/1985 | Bachman | 101/170 |
| 4,589,339 | 5/1986 | Fisher . | |
| 4,767,694 | 8/1988 | Schubert | 101/471 |
| 4,912,824 | 4/1990 | Baran | 101/170 |
| 5,072,671 | 12/1991 | Schneider et al. . | |
| 5,126,531 | 6/1992 | Majima et al. . | |
| 5,182,990 | 2/1993 | Kline et al. . | |
| 5,247,883 | 9/1993 | Kuwahara et al. . | |
| 5,259,311 | 11/1993 | McCaughey, Jr. . | |
| 5,278,027 | 1/1994 | Clarke . | |
| 5,370,052 | 12/1994 | Reslow | 101/483 |

*Primary Examiner*—Eugene H. Eickholt
*Attorney, Agent, or Firm*—McAulay Fisher Nissen Goldberg & Kiel, LLP

[57] ABSTRACT

A method used in offset printing utilizes an electrically encoded image, stored in an electronic memory, to be transferred to a printing substrate during a coating application in an offset printing process. An offset printing blanket is attached under tension to a blanket cylinder of an offset printing machine. After attachment of the blanket to the cylinder, the blanket is automatically cut in accordance with the electrically encoded image. Subsequently, sections of the blanket are removed along cut lines made in the outer layer during the cutting thereof.

21 Claims, 1 Drawing Sheet

METHOD AND APPARATUS FOR USE IN OFFSET PRINTING

BACKGROUND OF THE INVENTION

This invention relates to a method for use in offset printing. This invention also relates to an associated apparatus.

In offset printing, the matter to be reproduced is copied photographically onto a metal plate disposed on a cylinder of a printing press. The metal plate is then inked and rotated with the plate cylinder to make an imprint of the text or illustration on a rubber layer disposed on a respective cylinder. This cylinder is in turn rotated to print on sheets of paper which are automatically fed to the machine. An impression cylinder serves as the back-pressure cylinder which squeezes the paper sheets to the rubber-covered cylinder for transferring ink to the substrate for final reproduction. In addition, a coater apparatus is attached to a deck area of the printing press. When a job requires coating, the coater apparatus is shifted into direct contact with the rubber-covered cylinder while the plate cylinder is not operable to transfer ink images to the rubber surface.

Each cylinder of the offset printing press has a gap area for allowing clearance of a delivery gripper chain system. When a reproduction of spot coating is required, the printer has several options: he may purchase a DuPont CYREL (trademark) plate or a single, dual or multilayer printing blanket which is used in the offset process for transferring inked images, which is manufactured by Reeves International or Day International, Inc. The construction of the printing blanket can be either a compressible or a conventional design. The DuPont CYREL™ plate has a flexible photopolymer compound laminated in a layer to a polymeric carrier layer such as polyvinyl chloride or MYLAR™. A chemical developer is used to remove non-imaging, unexposed areas from the photopolymer compound layer of the plate. There follows a light exposure finishing procedure to harden the remaining polymer. After developing, the plate has two surface levels. A lower surface area is the non-image area, which does not receive a coating during a printing process, while a raised surface area receives a coating from the coating apparatus. The differential in height is referred to as the relief area. This relief area ranges from 10 to 30 thousandths of an inch for the CYREL™ system.

An offset printing blanket for providing a raised surface for spot coating reproduction is also commonly used by offset printers. The blanket has an upper rubber layer removably attached to an underlying, woven fabric layer. The printing blanket is attached to the blanket cylinder so that the fabric layer is disposed inside, in contact with the cylinder, while the rubber layer is outside. If the blanket is pre-installed around its cylinder, a manual or freehand cutting of the rubber layer is required. This manual or freehand cutting technique is time consuming and limited in practice to extremely simple patterns because of the difficulty in achieving accuracy.

Some printers cut the rubber layer of a printing blanket before installing it on the blanket cylinder of an offset printing press. This process is accomplished by using a multicutting plotter, for example, manufactured by Misomex, which provides accurate cuts over a wide range of complicated shapes and designs. The rubber blanket is cut in a flat orientation and subsequently attached to the blanket cylinder. Distortion introduced by the mounting tension requires special compensating steps, in order to reproduce the coating in the exact location of the printed design once the carrier material is wrapped around the blanket cylinder.

The distortion caused by mounting tension can vary considerably. The average tension is estimated to be about 50 lbs. per inch of width. Distortion will depend not only on the average applied tension but on a number of other factors including the thickness of the carrier material and the diameter of the blanket cylinder. Distortion may occur in both the circumferential direction and the axial direction.

Pre-installation compensation for distortion in a raised surface spot image carrier material entails extremely detailed calculations. Software or computer programs have been developed for predicting distortion and compensating for the predicted distortion by modifying cuts which would otherwise be made in the rubber layer of a printing blanket. Nevertheless, results in distortion compensating have been inconsistent and time consuming, in part because of the various types of spot coating carrier material and the many different types of printing presses and the tension factors for proper mounting. In brief, the chance for error when calibrating for distortion is significant.

OBJECTS OF THE INVENTION

An object of the present invention is to provide a method for forming a raised surface for spot coating reproduction in offset printing.

Another object of the present invention is to provide such a method wherein the effects of distortions of the printing blanket or other carrier material (such as CYREL) owing to attachment tension are reduced, if not eliminated.

A further particular object of the present invention is to provide an apparatus for carrying out the methodology of the invention.

These and other objects of the present invention will be apparent from the drawings and detailed descriptions herein.

SUMMARY OF THE INVENTION

A method used in offset printing utilizes, in accordance with the present invention, an electrically encoded image, stored in an electronic memory, to be transferred to a printing substrate during a coating applicaton in an offset printing process. The method includes attaching an offset printing blanket or flexible coating-transfer substrate under tension to a blanket cylinder of an offset printing machine. After attachment of the blanket to the cylinder, the blanket is automatically cut in accordance with the electrically encoded image. Subsequently, sections of the blanket are removed along cut lines made in the blanket during the cutting thereof.

The cutting of the printing blanket may be implemented by operating a laser cutting device. Alternatively, the cutting may be accomplished with a knife, a drill, a rotating or reciprocating saw, or any other equivalent cutting member. One or more micrometers may be provided for enabling an accurate adjustment in the depth of cutting where the cutting is performed, for instance, by a knife, drill or saw.

The printing blanket may be a flexible single, dual or multilayer sheet such as manufactured by Day International or Reeves International. Alternatively, a single, dual or multilayer printing blanket may be attached in part via an adhesive backing to a metal plate which is then mounted to the blanket cylinder. In the former case, only the upper or outer layer of the blanket sheet is cut and removed. In the latter case, the sheet is cut through to an underlying metal surface, e.g., of the metal plate which is mounted to the blanket cylinder.

The laser cutting device may be operated by a computer which receives image information from the memory. Moreover, the computer may be operated to position and reposition the laser cutting device relative to the blanket. The computer may also be operated to change an angular positioning of the cylinder.

The electrically encoded image information may be previously fed to the electronic memory by scanning a pre-existing image, for example, on a sheet of paper. The scanning may be accomplished via a video camera. A digitized signal produced by the video camera or derived from the output thereof is processed by the computer to produce image information recorded in the memory.

Pursuant to one use of the present invention, it is contemplated in this method that each of the cut lines made in the printing blanket is an essentially continuous curvilinear cut. In this case, the cutting procedure produces essentially only closed sections in the printing blanket. Those sections are separated from an inner layer of the blanket during the removing step.

The present invention could additionally be used in forming continuous vertical or horizontal cuts. The vertical or horizontal cuts are generally done to delete the glue flaps in the printing and manufacturing of a folding box carton. This prevents the coating from reproducing in the glue flap area or the non-image relief area.

The printing blanket is attached to the cylinder via normal blanket mounting components provided by the press manufacturer such as coupling rods.

An apparatus used in offset printing comprises, in accordance with the present invention, (a) a memory for storing an electrically encoded image to be transferred to a printing substrate during a coating application in an offset printing process, (b) a rotatable blanket cylinder, (c) means for removably attaching an offset printing blanket or any other flexible coating-transfer substrate under tension to the cylinder, (d) a cutter for forming continuous curvilinear cuts in the blanket, and (e) a controller operatively connected to the memory and the cutter for controlling the cutter to form, in the blanket in accordance with the electrically encoded image, continuous curvilinear cuts defining removable closed forms in the blanket.

According to another feature of the present invention, the cutter includes a laser cutting device. The controller preferably includes or takes the form of a computer programmed to control the cutter to form the continuous curvilinear cuts defining removable closed forms in the blanket in accordance with the electrically encoded image.

The cutter may further include positioning componentry such as a carriage mounted along a linear track extending axially relative to the blanket cylinder. The carriage carries the laser cutting device for positioning that device relative to the cylinder. The computer is operatively connected to the positioning componentry for controlling the operation thereof. More particularly, the computer has output leads extending to a drive for moving the carriage back and forth along the track as the cylinder rotates about its longitudinal axis.

According to a further feature of the present invention, the cutter additionally incorporates angular positioning componentry operatively coupled to the blanket cylinder for rotating the cylinder during a cutting operation. The computer is operatively connected to the angular positioning componentry for controlling an angular positioning of the cylinder.

A scanner is connected to the memory, for example, via the computer, for scanning a pre-existing image and transmitting, to the memory, electrical signals encoding the pre-existing image. The scanner may include an optical scanner such as a video camera. The scanner inputs to the memory, via the computer, a digitized image corresponding to a graphical pattern embodied, for example, on a sheet of paper. Alternatively, the pattern or image to be reproduced on the printing blanket and transferred therefrom to the printing substrate may be produced via a graphics program and stored in memory.

A method in accordance with the present invention enables one to create a spot coating relief raised surface for any type of carrier material and any type of printing press, for reproducing any shape or design with pinpoint accuracy to the exact location of the printed design. Because an image or pattern is generated in the printing blanket only after the attachment thereof to the roller or cylinder, the effects of distortion due to tension are eliminated. The tension is automatically compensated because the blanket is cut while under essentially the same tension extant during the printing or coating process.

An apparatus in accordance with the present invention may be retrofitted to coating stations of existing offset printing presses. An interface may be established with the prepress department to generate the data necessary to control the cutting device to form the raised image surfaces on the printing blanket or carrier material for providing the desired spot coating.

A method in accordance with the present invention eliminates the complex calculations otherwise required to compensate for distortion factors when preparing for spot coating applications. In response to data generated in the prepress department, the cutting device will automatically cut on press, under the control of the computer, a raised image surface on the carrier material or printing blanket which will be in perfect registration and alignment with the printed shape or design.

A method in accordance with the present invention eliminates the need for toxic developers which are conventionally used to remove non-imaging, unexposed areas from a photopolymer compound layer of a printing plate.

A method and apparatus in accordance with the present invention will provide accurate and consistent raised image surfaces on a carrier material, directly on the printing cylinder of a printing press.

DETAILED DESCRIPTION

Figure 1:
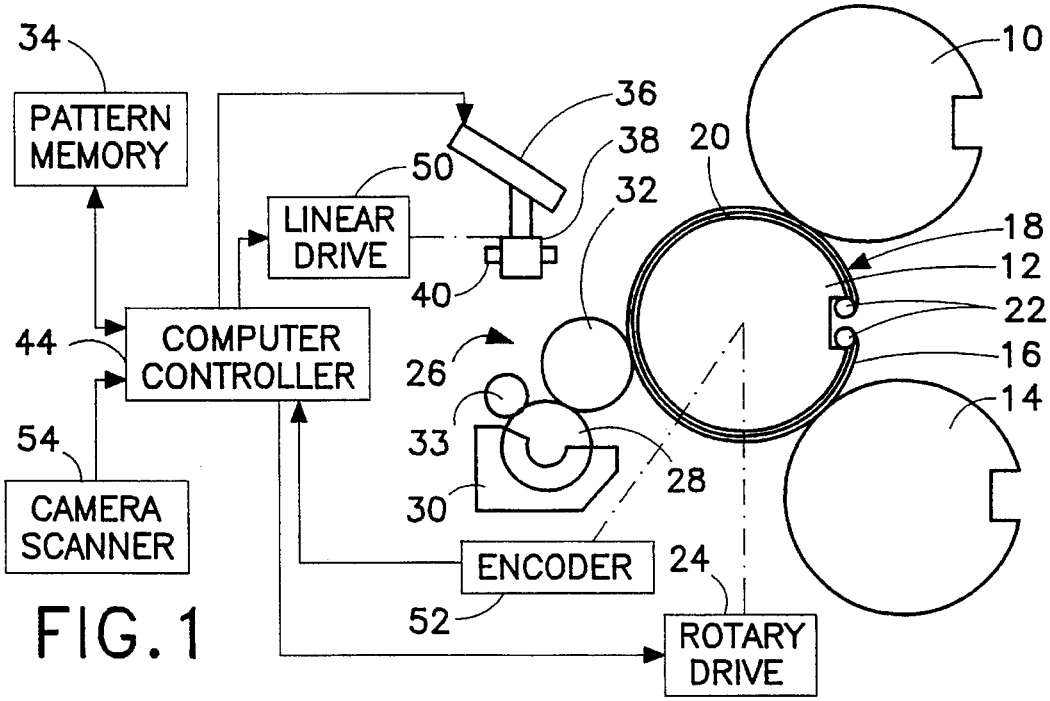
FIG. 1 is a diagram of an offset printing press incorporating apparatus in accordance with the present invention.

As illustrated in FIG. 1, an offset printing press machine includes a plate cylinder 10, a blanket cylinder or roller 12, and an impression cylinder 14. Matter to be reproduced is copied photographically onto a metal plate (not shown) disposed on plate cylinder 10. The metal plate on cylinder 10 is inked and rotated with the plate cylinder to make an imprint of the text or illustration on a rubber layer 16 disposed on blanket cylinder 12.

Rubber layer 16 is an outer or upper layer of a dual layer printing blanket or carrier 18. Rubber layer 16 is attached to an underlying inner layer 20 made of fabric material. Printing blanket 18 is attached under tension to a cylindrical outer surface of blanket cylinder 12 via a pair or rods 22 attached to free ends of the printing blanket.

Blanket or printing cylinder 12 is rotated via a rotary drive 24 to print on sheets of paper (not shown) which are automatically fed to the printing press. Impression cylinder 14 serves to provide back-pressure to squeeze the paper sheets to the rubber-covered blanket cylinder 12 for transferring ink or coating to the substrate for final reproduction.

A coater apparatus 26 attached to a deck area (not designated) of the printing press includes a pick-up roller 28 for collecting a coating composition from a coating pan 30. The coating composition is transfered from pick-up roller 28 to rubber layer 16 of printing blanket 18 via an applicator roller 32. Coater apparatus 26 further includes a metering roller 33 and is generally totally retractable when not in service. When a job requires coating, coater apparatus 26 is shifted into direct contact with rubber-covered blanket cylinder 12 while plate cylinder 10 is not operable to transfer ink images to rubber layer 16. It is to be noted that a coater apparatus may include only one or two rollers instead of three. It can be a non-retractable dedicated coater apparatus such as a TOWER™ coater manufactured by Mann Roland.

As further illustrated in FIG. 1, an electronic memory 34 is provided for storing electrically encoded image or pattern information. That information defines an image, pattern or graphic design to be transferred to a printing substrate by blanket cylinder or roller 12 during spot or patent coating application in an offset printing process. A cutter 36 such as a laser source, a blade, a saw or a drill, is mounted to a carriage 38 in proximity to blanket cylinder 12 for cutting outer, rubber layer 16 of printing blanket 18. Carriage 38 is linearly shiftable along tracks 40 which extend axially relative to blanket cylinder 12, i.e., parallel to cylinder 12. One or more micrometers (not shown) may be provided on carriage 38 for enabling an accurate adjustment in the depth of cutting where the cutting is performed, for instance, by a knife, drill or saw.

Figure 2:
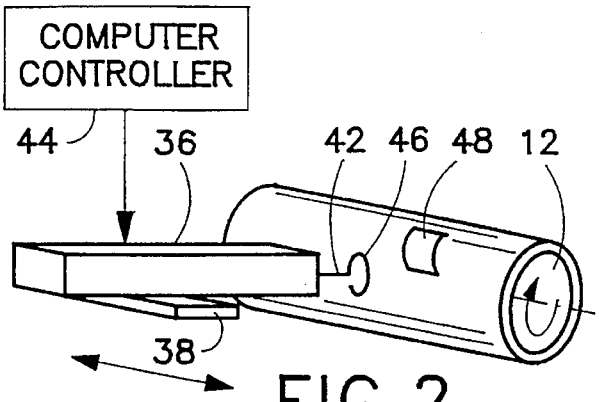
FIG. 2 is a schematic perspective view of cutter componentry included in the printing press of FIG. 1 in accordance with the present invention.
Figure 3:
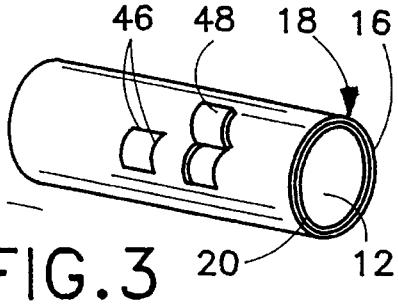
FIG. 3 is a schematic perspective view of a printing blanket or dual-layer carrier material, showing a printing blanket with an outer layer having removable sections formed in accordance with the present invention.

FIG. 2 shows blanket cylinder 12, printing blanket 18, and carriage 38. In addition, cutter 36 is shown as a laser which generates a cutting beam 42. A controller 44 realizable as a computer or microprocessor is operatively connected to memory 34 (FIG. 1) and cutter 36 for controlling the cutter to form, in rubber layer 16, continuous curvilinear cuts 46 which define (possibly with outer edges of blanket 18) removable closed forms 48 in layer 16 in accordance with the image or pattern information stored in memory 34. Closed forms 48 of rubber layer 16 are removed after the formation of cuts 46 and prior to a coating process wherein a coating composition is transferred from coating pan 30 to raised portions of printing blanket 18 (unremoved portions of outer, rubber layer 16) via pick-up roller 28 and applicator roller 32.

Computer controller 44 is connected to a linear drive 50 which moves carriage 38 along tracks 40. The direction and rate of movement of carriage 38 is determined by computer controller 44 in accordance with the image or pattern information stored in memory 34 and the rate of rotation of blanket cylinder 12 during the cutting operation. Computer controller 44 may also be connected to a rotary drive 24 for controlling the angular speed and direction of rotation of blanket cylinder 12. The computer controller 44 obtains feedback as to the angular position and angular velocity of cylinder 12 via an angular encoder 52.

Thus, it is apparent from the foregoing that computer controller 44 coordinates the energization or operation of cutter 36, the movement of carriage 38, the rotation of blanket cylinder 12 to form a pattern or design in outer, rubber layer 16 only after the attachment of printing blanket 18 to cylinder 12 and the subjecting of blanket 18 to substantially all the distorting tensions it will experience during a coating procedure in an offset printing process.

As further illustrated in FIG. 1, an optical scanner 54 such as a camera is connected to computer controller 44 and from thence to memory 34 for scanning a pre-existing image, for example, on paper, and generating signals encoding that image. Those signals or processed forms thereof are transmitted to memory 34 for storage therein. It is to be noted, that the pattern or image information in memory 34 may be generated by computer controller 44 or another computer (not shown) through the use of a graphics program.

Figure 4:
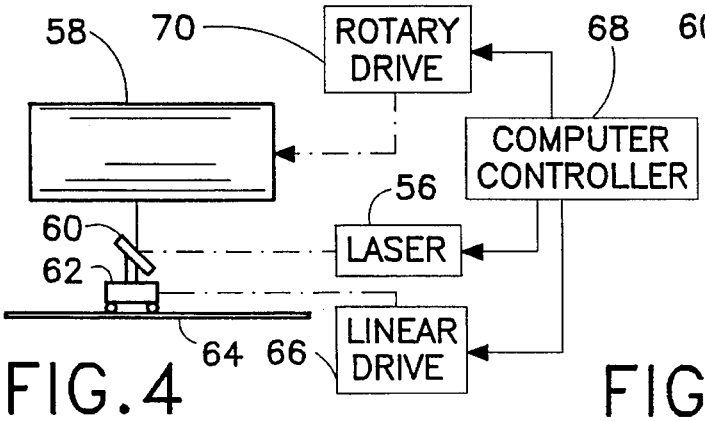
FIG. 4 is partially a block diagram and partially a side elevational view of modifications in a printing press apparatus in accordance with the present invention.

As illustrated in FIG. 4, a laser source 56 may be disposed in a stationary location. A laser beam produced by laser source 56 is directed to a printing blanket 58 on a printing cylinder (not separately enumerated) by suitable optics 60 provided on a carriage 62. Carriage 62 is shiftable along a track 64 by a linear drive 66 in response to signals from a computer controller 68. Track 64 extends parallel to the printing cylinder which is rotable by a rotary drive 70 under the control of computer controller 68.

Figure 5:
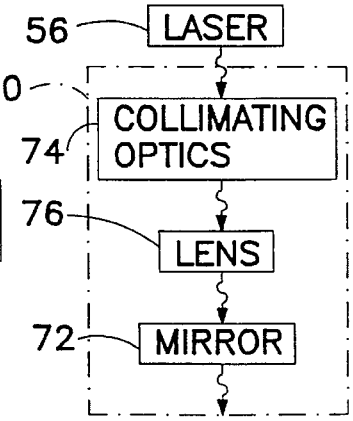
FIG. 5 is a block diagram showing elements of a laser cutting system in accordance with the present invention.

Optics 60 may include a mirror 72, as well as collimating optics 74 and a lens 76, as depicted diagrammatically in FIG. 5.

In using the printing press apparatus of FIG. 1, an electrically encoded image, pattern or graphic design is stored in memory 34. The image or pattern data is generated by camera scanner 54 or by a graphics program. Prior to the formation of cuts 46, dual-layer offset printing blanket 18 is attached under tension to cylinder 12 of the offset printing machine. After attachment of printing blanket 18 to cylinder 12, outer layer 16 of blanket 18 is automatically cut in accordance with the electrically encoded image. Subsequently, sections 48 of outer layer 16 are removed along cut lines 46 made in the outer layer during the cutting thereof.

Although the invention has been described in terms of particular embodiments and applications, one of ordinary skill in the art, in light of this teaching, can generate additional embodiments and modifications without departing from the spirit of or exceeding the scope of the claimed invention. For example, a single, dual or multilayer printing blanket may be attached in part via an adhesive backing to a metal plate which is then mounted to the blanket cylinder. In that case, the sheet is cut through to an underlying metal surface, e.g., of the metal plate which is mounted to the blanket cylinder.

Accordingly, it is to be understood that the drawings and descriptions herein are profferred by way of example to facilitate comprehension of the invention and should not be construed to limit the scope thereof.

What is claimed is:

1. A method used in offset printing, comprising:

providing, in an electronic memory, an electrically encoded image to be transferred to a printing substrate during a coating application in an offset printing process;

attaching an offset printing blanket under tension to a blanket cylinder of an offset printing machine;

after attachment of said blanket to said cylinder, automatically cutting said blanket in accordance with said electrically encoded image; and removing sections of said blanket along cut lines made in said blanket during the cutting thereof.

2. The method defined in claim 1 wherein the cutting of said blanket includes automatically operating a cutting device.

3. The method defined in claim 2 wherein the cutting of said blanket includes operating a computer to change a positioning of said cutting device relative to said blanket, said computer being operatively connected to said memory.

4. The method defined in claim 3 wherein the cutting of said blanket also includes operating said computer to change an angular positioning of said cylinder.

5. The method defined in claim 2 wherein said cutting device is a laser cutting device and the operating of said laser cutting device includes operating a computer to control energization of said laser cutting device, said computer being operatively connected to said memory.

6. The method defined in claim 2, further comprising the step of making micrometer adjustments to said cutting device to control depth of cutting of said blanket.

7. The method defined in claim 2 wherein said cutting device is a knife.

8. The method defined in claim 1 wherein said blanket is a dual-layer printing blanket, said cutting including the step of cutting essentially only an outer layer of said blanket, the removed sections of said blanket being of said outer layer.

9. The method defined in claim 1 wherein the step of providing said electrically encoded image includes:

scanning a pre-existing image;

thereafter converting said pre-existing image into electrical signals; and storing said electrical signals.

10. The method defined in claim 9 wherein said scanning includes optically scanning.

11. The method defined in claim 1 wherein each of said cut lines is an essentially continuous curvilinear cut in said blanket, the cutting of said blanket including forming essentially only continuous curvilinear cuts in said blanket.

12. The method defined in claim 11 wherein said cut lines and outer edges of said blanket essentially define only closed sections in said blanket.

13. The method defined in claim 1, further comprising shifting a coating device into contact with raised portions of said blanket after said sections have been removed and operating said coating device to provide a spot coating image on said blanket, a plate cylinder of said offset printing machine being inoperative to transfer ink images to the rubber surface during the operation of said coating device to provide a spot coating on said printing blanket.

14. The method defined in claim 1 wherein said step of attaching includes coupling said blanket to a metal plate via an adhesive layer and subsequently attaching said metal plate with said blanket to said cylinder.

15. An apparatus used in offset printing, comprising:

memory means for storing an electrically encoded image to be transferred to a printing substrate during a coating application in an offset printing process;

a rotatable blanket cylinder;

means for removably attaching an offset printing blanket under tension to said cylinder;

cutting means for forming continuous curvilinear cuts in said blanket; and controller means operatively connected to said memory means and said cutting means for controlling said cutting means to form, in said blanket in accordance with said electrically encoded image, continuous curvilinear cuts defining removable closed forms in said blanket.

16. The apparatus defined in claim 15 wherein said cutting means includes a laser cutting device.

17. The apparatus defined in claim 16 wherein said controller means includes a computer programmed to control said cutting means to form continuous curvilinear cuts in said blanket in accordance with said electrically encoded image.

18. The apparatus defined in claim 17 wherein said cutting means further includes positioning means operatively coupled to said laser cutting device for positioning same relative to said cylinder, said computer being operatively connected to said positioning means for controlling the operation thereof.

19. The apparatus defined in claim 18 wherein said cutting means further includes angular positioning means operatively coupled to said cylinder for rotating same during a cutting operation, said computer being operatively connected to said angular positioning means for controlling an angular positioning of said cylinder.

20. The apparatus defined in claim 15, further comprising scanning means operatively connected to said memory means for scanning a pre-existing image and transmitting, to said memory, electrical signals encoding said pre-existing image.

21. The apparatus defined in claim 20 wherein said scanning means includes an optical scanner.

* * * * *